US005880075A

United States Patent [19]

Hartley et al.

[11] Patent Number: 5,880,075

[45] Date of Patent: Mar. 9, 1999

[54] SYNTHETIC BIODEGRADABLE LUBRICANTS AND FUNCTIONAL FLUIDS

[75] Inventors: Rolfe J. Hartley, Cranbury, N.J.; Carolyn B. Duncan, Baton Rouge, La.; George Mortimer Tiffany, III, Cranbury, N.J.

[73] Assignee: Exxon Chemical Patents Inc, Linden, N.J.

[21] Appl. No.: 934,965

[22] Filed: Sep. 22, 1997

[51] Int. Cl.[6] ..... C10M 105/36

[52] U.S. Cl. ..... 508/501; 508/485; 44/389

[58] Field of Search ..... 508/501; 44/485

[56] References Cited

U.S. PATENT DOCUMENTS

| | | | |
|---|---|---|---|
| 4,994,196 | 2/1991 | Kagaya et al. | 252/32.5 |
| 5,378,249 | 1/1995 | Morrison | 44/388 |
| 5,562,867 | 10/1996 | Tiffany, III et al. | 508/497 |
| 5,658,863 | 8/1997 | Duncan et al. | 508/501 |
| 5,681,800 | 10/1997 | Duncan et al. | 508/501 |

FOREIGN PATENT DOCUMENTS

| | | | |
|---|---|---|---|
| WO94/05745 | 3/1994 | WIPO | C10M 105/42 |

*Primary Examiner*—Jacqueline V. Howard

[57] ABSTRACT

Synthetic biodegradable lubricants and functional fluids containing 45–94 wt. % of an ester of a $C_5$–$C_{10}$ acid as the base oil, 5–18% of a polyol ester of a $C_{12}$–$C_{28}$ acid as a lubricity additive, and 1–35 wt. % of an additive package for lubricants and functional fluids.

9 Claims, No Drawings

SYNTHETIC BIODEGRADABLE LUBRICANTS AND FUNCTIONAL FLUIDS

This invention relates to ester compositions useful as lubricants and functional fluids. More particularly this invention relates to biodegradable synthetic oils which exhibit improved lubricity and anti-wear properties and also satisfy environmental standards for aquatic toxicity.

The use of mixtures of synthetic esters in lubricants is generally known in the art and is disclosed, for example, in U.S. Pat. No. 4,994,196 (1991) which discloses two-cycle oils comprising alpha-olefin dicarboxylic ester copolymers in combination with esters of pentaerythritol and calcium phenate. Also U.S. Pat. No. 5,378,249 (1995) generally discloses biodegradable synthetic two-cycle engine oils which comprise 20–80% of a heavy ester having a viscosity of at least 7 cSt at 100° C. in combination with 10–85 wt. % of a light ester having a viscosity less than 6.0 cSt at 100° C. WO94/05745 (1994) discloses mixed polyol esters of $C_{16}$–$C_{20}$ and $C_5$–$C_{10}$ carboxylic acids. U.S. Pat. No. 5,562,867 (1996) discloses two-cycle oils based on $C_{13}$ oxo alcohol adipate.

The present invention is based on the discovery that esters of certain polyols with $C_{12}$–$C_{28}$ carboxylic acids are highly effective as lubricity additives when combined with a base oil ester of an alcohol and a $C_5$–$C_{10}$ carboxylic acid. This ester combination provides an oil which is a suitable biodegradable lubricant or functional fluid and exhibits lubricity and anti-wear properties.

In accordance with this invention, there has been discovered a biodegradable lubricant or functional fluid composition which comprises:

(A) 45–94 wt. % of a synthetic ester base oil which is an ester of an alcohol and a carboxylic acid, the ester having a viscosity of 4.0–12.0 cSt at 100° C. and the acid having 5 to 10 carbon atoms, (B) 5–18 wt. % of a second ester effective to enhance the lubricity and antiwear properties of the composition, said second ester being prepared from (i) a polyol selected from the group consisting of trimethylolpropane, pentaerythritol, dipentaerythritol and neopentyl glycol and (ii) an aliphatic monocarboxylic acid having 12 to 28 carbon atoms, and (C) 1–35 wt. % of an additive package for lubricants or functional fluids, wherein the composition has a biodegradability of at least 55% as measured by the ASTM D 5864-95 modified Sturm test and exhibits environmentally acceptable aquatic toxicity properties.

The base ester oil may generally be described as an alcohol ester having a viscosity of about 4–12 cSt at 100° C. and being an ester of a $C_5$–$C_{10}$ (5 to 10 carbon atoms) linear or branched, aromatic or aliphatic carboxylic acid.

The base ester oil may be prepared from monohydric or polyhydric alcohols. Suitable monohydric alcohols are the aliphatic alcohols having about 1 to about 18 carbon atoms, preferably about 5 to 15 carbon atoms, including both straight and branched chain alcohols, such as the oxo alcohols, particularly oxo tridecyl alcohol or oxo isodecyl alcohol.

Suitable polyhydric alcohols (polyols) may be represented by the formula:

$$R(OH)_n$$

where R is an aliphatic or cycloaliphatic hydrocarbyl group and n is at least 2. The hydrocarbyl group may contain about 2–20 carbon atoms. Such polyols may contain about 2–10 hydroxyl groups, more preferably about 2–6 hydroxyl groups. Particularly useful polyols are neopentyl glycol, trimethylolethane, trimethylolpropane, trimethylolbutane, mono-pentaerythritol, technical grade pentaerythritol, dipentaerythritol, ethylene glycol, propylene glycol and polyalkylene glycols. Particularly preferred is technical grade pentaerythritol which contains about 86–90% by wt. mono-pentaerythritol, 7–12% di-pentaerythritol and 1–2% tripentaerythritol.

Suitable acids for reaction with the alcohols are moncarboxylic and polycarboxylic acids having about 5–10 carbon atoms, preferably those monocarboxylic acids having about 8–10 carbon atoms which are methyl branched or mixtures of linear and branched acids containing methyl branching. Particularly preferred is a mixture of monocarboxylic acids comprising about 45–55 mole % of branched $C_8$ (eight carbon atoms) acids, preferably about 45 mole % and about 55–45 mole % of the mixture of linear $C_8$ and linear $C_{10}$ (10 carbon atoms) acids, preferably 55 mole %. The acid mixture of linear octanoic and decanoic acids comprises about 48–58 mole % of $C_8$ and 36–42 mole % of $C_{10}$ and very minor amounts of linear $C_6$ (6 carbon atoms) and $C_{12}$ (12 carbon atoms) acids, e.g., 3–5 mole % n-$C_6$ and 0.5–1 mole % n-$C_{12}$ acids being typically present. A preferred ester base oil for use in this invention is a technical grade ester of the aforesaid mixed $C_8$ branched and $C_8$–$C_{10}$ linear monocarboxylic acids. This ester oil has a viscosity of about 6.8 cSt at 100° C.

Polycarboxylic acids suitable for preparing ester base oils includes adipic acid, sebacic acid, phthalic acid, succinic acid, terephthalic acid, fumaric acid, trimellitic acid, as well as the anhydrides thereof. Preferred are esters of dicarboxylic acids such as adipate and phthalate esters made with oxo alcohols having 10 to 13 carbon atoms, and as oxo tridecyl adipate.

The ester base oils are present in the compositions of this invention in an amount of about 45–94 wt. %. Preferred embodiments comprise biodegradable two-cycle oils containing about 50–60 wt. % of the ester base oil component with about 6–8 wt. % of the second ester lubricity additive, and the balance being a conventional additive package used in two-cycle oils, which includes solvents and viscosity diluents. Another preferred embodiment is a hydraulic fluid containing about 85–90 wt. % base ester oil, 5–10 wt. % of the second ester and 1–5 wt. % of an additive package comprising anti-oxidants, rust and corrosion inhibitors, demulsifiers, anti-wear agents and defoamers.

The essential aspect of this invention is the use of the second ester as a lubricity additive in combination with the ester base oil in order to meet the lubricating and functional fluid performance requirements without losing biodegradability. The lubricity additive may be an ester of trimethylolpropane, pentaerythritol, or dipentaerythritol with a $C_{12}$–$C_{28}$ (12 to 28 carbon atoms) saturated linear or branched aliphatic monocarboxylic acid, with esters of $C_{18}$–$C_{24}$ acids, such as isostearic acid being preferred. Particularly preferred for use in the compositions of the present invention is trimethylolpropane isostearate. The lubricity additive should be present in an amount ranging from about 5–18 wt. %.

The invention further comprises the presence of 1–35% by weight of an additive package which contains one or more conventional lubricating oil additives, and these may be any additive normally included in lubricating oils or functional fluids for a particular purpose.

Such conventional additives which may be present in the composition of this invention include viscosity modifiers, corrosion inhibitors, oxidation inhibitors, friction modifiers, dispersants, antifoaming agents, antiwear agents, pour point depressants, detergents, rust inhibitors and the like.

Typical oil soluble viscosity modifying polymers are ethylene alpha-olefin copolymers which generally have weight average -molecular weights of from about 10,000 to 1,000,000 as determined by gel permeation chromatography.

Corrosion inhibitors are illustrated by phosphosulfurized hydrocarbons and the products obtained by reacting a phosphosulfurized hydrocarbon with an alkaline earth metal oxide or hydroxide. Benzotriazole in propylene glycol is preferred for use in this invention.

Oxidation inhibitors are antioxidants exemplified by alkaline earth metal salts of alkylphenol thioesters having preferably $C_5$–$C_{12}$ alkyl side chain such as calcium nonylphenol sulfide, barium t-octylphenol sulfide, dioctylphenylamine as well as sulfurized or phosphosulfurized hydrocarbons. Also included are oil soluble antioxidant copper compounds such as copper salts of $C_{10}$ to $C_{18}$ oil soluble fatty acids.

Friction modifiers include fatty acid esters and amides, glycerol esters of dimerized fatty acids and succinate esters or metal salts thereof.

Dispersants are well known in the lubricating oil field and include high molecular weight alkyl succinimides being the reaction products of oil soluble polyisobutylene succinic anhydride with ethylene amines such as tetraethylene pentamine and borated salts thereof. Preferred for use in this invention is a dispersant comprising a polyisobutenyl (Mn 950) succinimide.

Pour point depressants, also known as lube oil flow improvers can lower the temperature at which the fluid will flow and typical of these additives are $C_{8-C18}$ dialkyl fumarate vinyl acetate copolymers, polymethacrylates and wax naphthalene.

Foam control can also be provided by an anti-foamant of the polysiloxane type such as silicone oil and polydimethyl siloxane; acrylate polymers are also suitable.

Anti-wear agents reduce wear of metal parts and representative materials are zinc dialkyldithiophosphate, zinc diaryl diphosphate, and sulfurized isobutylene.

Detergents and metal rust inhibitors include the metal salts of sulfonic acids, alkylphenols, sulfurized alkylphenols, alkyl salicylates, naphthenates and other oil soluble mono and dicarboxylic acids such as tetrapropyl succinic anhydride. Neutral or highly basic metal salts such as highly basic alkaline earth metal sulfonates (especially calcium and magnesium salts) are frequently used as such detergents. Also useful is nonylphenol sulfide. Similar materials made by reacting an alkylphenol with commercial sulfur dichlorides. Suitable alkylphenol sulfides can also be prepared by reacting alkylphenols with elemental sulfur.

Also suitable as detergents are neutral and basic salts of phenols, generally known as phenates, wherein the phenol is generally an alkyl substituted phenolic group, where the substituent is an aliphatic hydrocarbon group having about 4 to 400 carbon atoms.

The compositions of this invention exhibit satisfactory aquatic toxicity properties. ASTM D6081 defines the procedures for the preparation of test materials for aquatic toxicity testing. The preparation method may be either: Water Accommodated Fraction (WAF), Water Soluble Fraction (WSF) or Mechanical Dispersion. In this test, the toxicity of samples to aquatic organisms is determined by evaluating the sample's effects on a test population of fish. Oil composition samples are maintained as a dispersion of small droplets. Controlled amounts of the samples are added to test chambers where the effects on the fish are observed. Test duration is ninety-six (96) hours. Toxicity of the samples is recorded in terms of LC50, which represents the Lethal Concentration at which 50% of the test population dies. Although there is no uniform criteria for toxicity labeling, degrees of toxicity generally fall within the following categories:

| LC50 Value (ppm) | Category |
|---|---|
| </=1 | Highly or Very Toxic |
| 1–10 | Toxic or Moderately Toxic |
| 10–100 | Harmful or Slightly Toxic |
| 100–1000 | No Risk or Practically Non-Toxic |
| >1000 | Non-Hazardous |

The compositions of this invention will generally have an LC50 value >1000.

A preferred embodiment of this invention are two-cycle oils containing the ester combination. Such biodegradable, synthetic two-cycle oil composition may generally be described as comprising a base ester oil having a viscosity of about 4–12 cSt at 100° C. and being a polyol ester of a $C_5$–$C_{10}$ linear or branched monocarboxylic acid, effective amounts of a two-cycle oil detergent/dispersant and a viscosity diluent being a light ester oil having a viscosity 1–6 cSt at 100° C. or an aliphatic alcohol having 4 to 12 carbon atoms or a mixture thereof, and, as a lubricity additive, 5–18% by wt. of an ester of trimethylolpropane, pentaerythritol, or dipentaerythritol with a C12–C28 saturated or unsaturated linear or branched monocarboxylic acid, the composition having a biodegradability of at least 55% in the ASTM D 5864-95 modified Sturm test and a Brookfield viscosity of less than 7,500 cps at −25° C.

Two cycle oils of this invention are also environmentally advantageous since no oily sheen is detected when the oils come into contact with water. They also have an aquatic toxicity LC50 value of >1000.

Among the suitable detergent/dispersants are basic nitrogen compounds which must have a basic nitrogen content as measured by ASTM D 664 or D 2896. Typical of such compositions are the oil soluble succinimides, carboxylic acid amides, hydrocarbyl monoamines, hydrocarbyl polyamines, Mannich bases, phosphoramides, thiophosphoramides, phosphonamides, and mixtures thereof. These materials may also be post-treated using various methods known in the art such as post treating compounds exemplified by urea, thiourea, carbon disulfide, aldehydes, ketones, carboxylic acids, hydrocarbon-substituted succinic anhydrides, nitrites, epoxides, boron compounds and the like.

Generally, the two-cycle oil compositions of this invention will contain about 5–20 wt. % detergent/dispersant, preferably about 15–19 wt. %.

Preferred succinimides for use in preparing two-cycle oils of the present invention are those prepared from reacting a hydrocarbyl succinic anhydride wherein the hydrocarbyl group has from about 60–350 carbon atoms and an ethylene amine exemplified by ethylene diamine, diethylene triamine, triethylene tetramine and tetraethylene pentamine. Particularly preferred are those succinimides prepared from polyisobutenyl succinic anhydrides from about 70–128 carbon atoms and tetraethylene pentamine. Particularly useful are polyisobutenyl succinimides wherein the polyisobutenyl group has a number average molecular weight (Mn) of 450 to 950 and mixtures thereof. Such dispersants are typically used in the form of 45–98 wt. % active ingredient in mineral oil solution. A preferred succinimide product is that prepared by condensing isostearic acid, polyisobutenyl (Mn 950)

succinic anhydride and tetraethylene pentamine (98% active ingredient in mineral oil solution). A composition having 7–8 wt. % of this detergent/dispersant and 7–8 wt. % of polyisobutenyl (Mn 950) succinimide (50.5 wt. % active ingredient in mineral oil) is a preferred embodiment.

Carboxylic acid amide detergent/dispersants are typically prepared by reacting a carboxylic acid or anhydride or ester thereof having about 12–350 carbon atoms then amine or polyamine. Another suitable class of detergent/dispersants are hydrocarbyl monoamines and hydrocarbyl polyamines where the hydrocarbyl group is alkyl or alkenyl and contains from about 9–350, preferably 20–200 carbon atoms. Particularly preferred are those derived by reacting polyisobutenyl chloride and a polyalkylene polyamine such as diethylene triamine or tetraethylene pentamine.

Another class of suitable detergent/dispersants are the Mannich based compositions which are prepared from a phenol or a $C_9$–$C_{200}$ alkyl phenol, an aldehyde, such as formaldehyde or formaldehyde precursor such as paraformaldehyde and an amine compound. The amine may be a monoamine or polyamine and typical compositions are prepared from an alkyl amine, such as methylamine or an ethyleneamine such as diethylene triamine or tetraethylene pentamine and the like. The phenolic material may be sulfurized and typically is dodecyl phenol or a $C_{80}$–$C_{100}$ alkyl phenol.

Also useful as detergent/dispersants are the phosphoramides and phosphonamides. These compositions are prepared by forming a phosphorus compound having at least one P-N bond and may be prepared, for example, by reacting phosphorus oxychloride with a hydrocarbyl diol in the presence of monoamine or by reacting phosphorus oxychloride with a difunctional secondary amine and a monofunctional amine.

Also suitable as detergent/dispersants in the composition of the present invention are alkyl amino phenols which may be prepared by alkylating a phenolic compound with an olefinic alkylating agent to form the alkylated phenol which is then nitrated to form an intermediate nitro phenol which can then be converted to the desired amino phenol by reducing at least some of the nitro groups to amino groups. Such amino phenols will generally contain an alkyl group located ortho or para to the hydroxyl group, the alkyl group containing about 30–400 carbon atoms and the phenol containing 1 or 2 $NH_2$ substituents, preferably 1 $NH_2$ substituent.

Another suitable class of detergent/dispersants for use in the composition of the present invention are ester dispersants which are prepared by reacting a hydrocarbyl-substituted carboxylic acylating agent with at least one organic hydroxy compound and optionally with an amine. Suitable hydroxy compounds may be aliphatic compounds such as monohydric and polyhydric alcohols or aromatic compounds such as phenols and naphthols. Suitable acylating agents include fatty monocarboxylic acids of about 8–30 carbon atoms.

Two-cycle compositions of this invention may contain an effective amount of a viscosity diluent as part of the additive package in order to regulate the viscosity of the finished product. It is important that this ingredient not adversely affect the biodegradability or engine performance properties of the two-cycle oil composition. Generally this component will be present in an amount of from 10–25 wt. %, preferably about 10–15 wt. %. It has been found in accordance with this invention that light esters having a viscosity of 1–6 cSt at 100° C. or aliphatic monohydric alcohols having about 4–12 carbon atoms are suitable for this purpose. The preferred ester is diisooctyl adipate which has a viscosity of 2.8 cSt at 100° C. Other suitable esters are oxo ditridecyl adipate having a viscosity of 5.3 cSt at 100° C. and isodecyl pelargonate having a viscosity of 1.14 cSt at 100° C. Other light ester oils may generally be described as reaction products of $C_5$–$C_{15}$ (5 to 15 carbon atoms) branched alcohols with unbranched $C_5$–$C_{15}$ aliphatic carboxylic mono or di acids. Preferred for use in the compositions of the present invention is 2.5–13% by wt. of isoheptyl or isodecyl alcohol or a mixture wherein there is present in the lubricating oil composition 1–10 wt. % of diisooctyl adipate and about 2.5–12% of isodecyl or isoheptyl alcohol with the proviso that the total amount of this viscosity diluent mixture in the lubricating oil composition does not exceed about 12–13% by wt. Effective viscosity control has also been achieved by having about 9.8% by wt. diisooctyl adipate and 9.6% by wt. oxo ditridecyl adipate present in the lubricating oil composition.

The two-cycle oil compositions of this invention are prepared by simply adding the ingredients to the base oil and blending the materials together, and oils prepared by this admixing method are a further embodiment of this invention.

The two-cycle lubricating oil composition of the present invention will mix freely with the fuels used in two-cycle engines. Admixtures of such lubricating oils with fuels comprise a further embodiment of this invention. The fuels useful in two-cycle engines are well known to those skilled in the art and usually contain a major portion of a normally liquid fuel such as a hydrocarbonaceous petroleum distillate fuel, e.g., motor gasoline as defined by ASTM specification D-439-73. Such fuels can also contain a non-hydrocarbonaceous material such as alcohols, ethers, organo nitro compounds, and the like, e.g., methanol, ethanol, diethyl ether, methylethyl ether, nitromethane and such fuels are within the scope of this invention as are liquid fuels derived from vegetable and mineral sources such as corn, alpha shale and coal. Examples of such fuel mixtures are combinations of gasoline and ethanol, diesel fuel and ether, gasoline and nitromethane, and the like. Particularly preferred is gasoline, that is, a mixture of hydrocarbons having an ASTM boiling point of 60° C. at the 10% distillation point to about 205° C. at the 90% distillation point.

The two-cycle lubricants of this invention are used in admixture with fuels in amounts of about 20–250 parts by wt. of fuel per 1 part by wt. of lubricating oil, more typically about 30–100 parts by wt. of fuel per 1 part by wt. of oil. Such admixtures and their use in two-cycle engines are further embodiments of this invention.

Other preferred embodiments are biodegradable functional fluids which are useful as metalworking fluids, compressor lubricants, hydraulic fluids, tractor fluids, industrial lubricants, universal lubricants, gear lubricants and the like. Such functional fluids may typically contain 85–90 wt. % of the synthetic ester base oil, about 8–12 wt. % of the polyol ester of a $C_{12}$–$C_{28}$ monocarboxylic acid as well as an additive package composed of about 1–5 wt. % of one or more anti-oxidants, anti-wear agents, corrosion inhibitors, anti-foamants, demulsifiers, and rust inhibitors.

Preferred is a hydraulic fluid composition where the base ester oil is oxo tridecyl adipate (87 wt. %), the second ester is trimethylolpropane isostearate (10 wt. %) and there is present 3% of a mixture of antioxidants, antiwear agents, corrosion inhibitors, antifoam and demulsifier additives. This preferred fluid exhibits superior results in the FZG test (IP 334179), is biodegradable, i.e. at least 55% on the ASTM D 5864-95 modified Sturm test, and exhibits acceptable aquatic toxicity properties, according to the Water Accommodated Fraction Test (ASTM D 6081).

The invention is further illustrated by the following examples which are not to be considered as limitative of its scope. The table in Example 1 below reports engine test results for the NMMA TC-W3 test. The engine employed in this test is an air cooled single cylinder Yamaha CE50S engine having these general specifications: displacement 3.0 cubic inches (49 cc.), cylinder bore 1.57 inches (40 mm), stroke 1.54 inches (39.2 mm), compression ratio 7.2:1.

EXAMPLE 1

An oil was prepared composed of the following ingredients and engine tested in the TC-W3 test.

| | Component | Wt. % |
|---|---|---|
| A | Dispersant prepared by condensing isostearic acid, polyisobutenyl (Mn 950) succinic anhydride and tetraethylene pentamine (98% active ingredient solution in mineral oil) | 7.912 |
| B | Polyisobutenyl (Mn 950) succinimide dispersant (50.5 wt. % active ingredient in mineral oil) | 7.786 |
| C | Diisooctyl adipate, 2.8 cSt at 100° C. | 9.785 |
| D | Oxo tridecyl adipate, 5.3 cSt at 100° C. | 9.616 |
| E | Technical grade pentaerythritol ester of a mixture of 45 mol % branched octanoic acid at 55 mol % of a mixture of linear octanoic and decanoic acids, 6.8 cSt at 100° C. | 58.172 |
| F | Trimethylolpropane isostearate | 6.729 |

The Brookfield viscosity was 6,870 cps at −25° C.

Its biodegradability was 61.10% (ASTM D 5864-95).

| Lubricity Test Results - TC-W3 | |
|---|---|
| Candidate | 4.92 |
| Reference | 5.12 |
| Difference | −0.2 |
| Pass/Fail | Pass |

EXAMPLE 2

Two hydraulic fluids were prepared and tested in the FZG gear rig test machine. This test, IP (Institute of Petroleum) 334/79, measures lubricity and in the test two steel spin gears are rotated together for a series of 75 minute stages. The relative torque between the gears is increased by a fixed amount after each stage and the gears are run together for a given period after which they are examined for wear or damage. The result of the test is quoted in terms of the final pass stage and the first fail stage. The pass stage should be greater than 8. The test is technically equal to ASTMD 5182-91.

| | A | B |
|---|---|---|
| Additive Package | 3% | 3% |
| Oxotridecyl Adipate | 87% | 87% |
| Trimethylolpropane isostearate | 10% | — |
| Ditridecyl Phthalate | — | 10% |
| FZG Result | 13 | 12 |

Oil A is the oil of he invention which shows a better FZG result. Oil B has a second ester outside the scope of the invention which is less effective as a lubricity additive. The additive package for both oils was the same and was a mixture of anti-oxidants anti-wear agents, corrosion inhibitors, demulsifiers and anti-foamants. Oil A also had a biodegradability of 61.3% and an aquatic toxicity value of LC50>1000 ppm according to the Water Accommodated Fraction procedure of ASTM D 6081.

What is claimed is:

1. A biodegradable lubricant or functional fluid composition which comprises:

(A) 45–94 wt. % of a synthetic ester base oil which is an ester of an aliphatic monohydric alcohol having 5 to 15 carbon atoms and a carboxylic acid the ester having a viscosity of 4.0–12.0 cSt at 100° C. and the acid having 5 to 10 carbon atoms, (B) 6–8 wt. % of an ester effective to enhance the lubricity and antiwear properties of the composition, said second ester being prepared from (i) a polyol selected from the group consisting of trimethylolpropane, pentaerythritol, dipentaerythritol and neopentyl glycol and (ii) an aliphatic monocarboxylic acid having 12 to 28 carbon atoms, and (C) 1–35 wt. % of an additive package for lubricants or functional fluids, wherein the composition has a biodegradability of at least 55% as measured by the ASTM D 5864-95 modified Sturm test and exhibits environmentally acceptable aquatic toxicity properties.

2. The composition of claim 1 wherein the monocarboxylic acid of component (B) has 18 to 24 carbon atoms.

3. The composition of claim 2 wherein the acid of component (B) is isostearic acid.

4. The composition of claims 2 or 3 wherein the polyol of component (B) is trimethylolpropane.

5. The composition of claim 1 which is a functional fluid.

6. The composition of claim 5 which is a hydraulic fluid.

7. A fuel lubricant admixture suitable for use in a two-cycle engine comprising about 20–250 parts by wt. of fuel per 1 part by wt. of the lubricating oil composition of claim 1.

8. The composition of claim 1 wherein the monohydric alcohol of the (A) component is oxo tridecyl alcohol or oxo isodecyl alcohol.

9. The composition of claims 1–6 or 8 which is prepared by admixing the ingredients.

* * * * *